US008096415B2

(12) United States Patent
Crosby

(10) Patent No.: US 8,096,415 B2
(45) Date of Patent: Jan. 17, 2012

(54) EXPIRATION DATE DEVICE FOR COSMETIC CONTAINERS

(76) Inventor: Cindy Marie Crosby, West Bloomfield, MI (US)

( * ) Notice: Subject to any disclaimer, the term of this patent is extended or adjusted under 35 U.S.C. 154(b) by 0 days.

(21) Appl. No.: 12/802,761

(22) Filed: Jun. 14, 2010

(65) Prior Publication Data

US 2011/0224060 A1 Sep. 15, 2011

Related U.S. Application Data

(60) Provisional application No. 61/337,981, filed on Mar. 12, 2010.

(51) Int. Cl.
*B65D 85/72* (2006.01)

(52) U.S. Cl. ..... 206/385; 206/459.1; 116/309; 116/315; 132/317; 401/88

(58) Field of Classification Search ..... 206/385, 206/459.1, 459.5, 581, 823; 116/200, 284, 116/306–309, 311, 315; 132/317, 318, 218; 401/52, 88, 89, 98, 126, 129, 194
See application file for complete search history.

(56) References Cited

U.S. PATENT DOCUMENTS

| | | | | |
|---|---|---|---|---|
| 2,713,845 | A * | 7/1955 | Silverman | 116/308 |
| 2,767,680 | A * | 10/1956 | Lermer | 116/308 |
| 4,877,119 | A * | 10/1989 | Hosking | 206/459.1 |
| 5,823,346 | A * | 10/1998 | Weiner | 206/459.1 |
| 6,311,840 | B1 * | 11/2001 | Shrader | 206/459.1 |
| 2004/0182733 | A1 * | 9/2004 | Dunlap | 206/459.1 |
| 2008/0000791 | A1 * | 1/2008 | Strong | 206/459.1 |

* cited by examiner

*Primary Examiner* — Luan K Bui
(74) *Attorney, Agent, or Firm* — Preston Smirman; Smirman IP Law, PLLC

(57) ABSTRACT

A system for providing an expiration month on cosmetic containers that store perishable make-up media including a container, a control, and a handle portion formed on the control. The handle portion has a greater outer diameter than an outer diameter of an exterior surface of the control wherein the greater outer diameter prevents the handle portion from entering the container, and a plurality of date-months formed on the exterior surface of the control in a sequential order in a first circumferential direction. The handle portion rotates the control in a second circumferential direction that is opposite the first circumferential direction thereby changing the date-months until the desired expiration date-month is visible in the aperture.

7 Claims, 9 Drawing Sheets

EXPIRATION DATE DEVICE FOR COSMETIC CONTAINERS

CROSS-REFERENCE TO RELATED APPLICATIONS

This application claims the benefit of U.S. Provisional Application No. 61/337,981, filed on Mar. 12, 2010. The disclosure of the above application is incorporated herein by reference.

FIELD

The present invention relates to cosmetic containers, and more particularly to date controls for cosmetic containers.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Trying to remember the month in which a make-up container was purchased and the month in which it should be replaced is tedious. Therefore, there has been and continues to be a need for a date indicator that has little complexity and provides the user with a robust date indicator system adaptable to any container.

SUMMARY

A system for providing an expiration month on cosmetic containers that store perishable make-up media including a container, a control, and a handle portion formed on the control. The handle portion has a greater outer diameter than an outer diameter of an exterior surface of the control wherein the greater outer diameter prevents the handle portion from entering the container, and a plurality of date-months formed on the exterior surface of the control in a sequential order in a first circumferential direction. The handle portion rotates the control in a second circumferential direction that is opposite the first circumferential direction thereby changing the date-months until the desired expiration date-month is visible in the aperture.

An adjustable date control for cosmetic containers housing perishable make-up media, including a container having a circumferential wall that defines an opening into a cylinder having a first and a second end, the cylinder is defined by an interior surface. The circumferential wall includes a transparent portion visible through an exterior surface and the interior surface. A control is engaged in the cylinder having a circumferential wall that defines an opening into a first end of a chamber that is defined by an interior surface of the circumferential wall and an exterior surface having a message portion that is visible through the transparent portion of the container wherein the message portion has each month of the year formed sequentially in a first circumferential direction around the message portion of the control, and a handle portion formed on the control adjacent a second end, the handle portion has an outer diameter that is greater than an outer diameter of the exterior surface of the circumferential wall. The handle portion moves the control in a second circumferential direction that is opposite the first circumferential direction.

The A cosmetic container having an adjustable date control, including a container having a circumferential wall that defines an opening into a cylinder at each of a first and a second end of the container, the cylinder is defined by an interior and an exterior surface wherein the interior and exterior surfaces define an aperture providing communication therebetween. A control is rotationally engaged with the container, the control having a shape that conforms to the cylinder, the control has a solid cross-section, wherein an exterior surface of the control that is adjacent a first end of the control defines a message portion formed thereon that is visible in the aperture wherein at least one male protuberance is formed on the message portion of the control. The exterior surface of the control adjacent is a second end of the control that defines a handle portion that enables the control to be rotated, the container includes an anti-rotation recess formed in the circumferential wall of the container having a first and a second lateral wall formed perpendicular to a longitudinal centerline of the container and spaced apart a first predetermined distance wherein the anti-rotation recess includes an anti-rotation wall that joins the first and second lateral wall along the longitudinal axis and a transitional step that joins the first and second wall along the longitudinal axis and is spaced apart a second predetermined distance from the anti-rotation wall, the circumferential wall having a maximum thickness at the transitional step and a minimum thickness where the first and second lateral walls join the anti-rotational wall.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
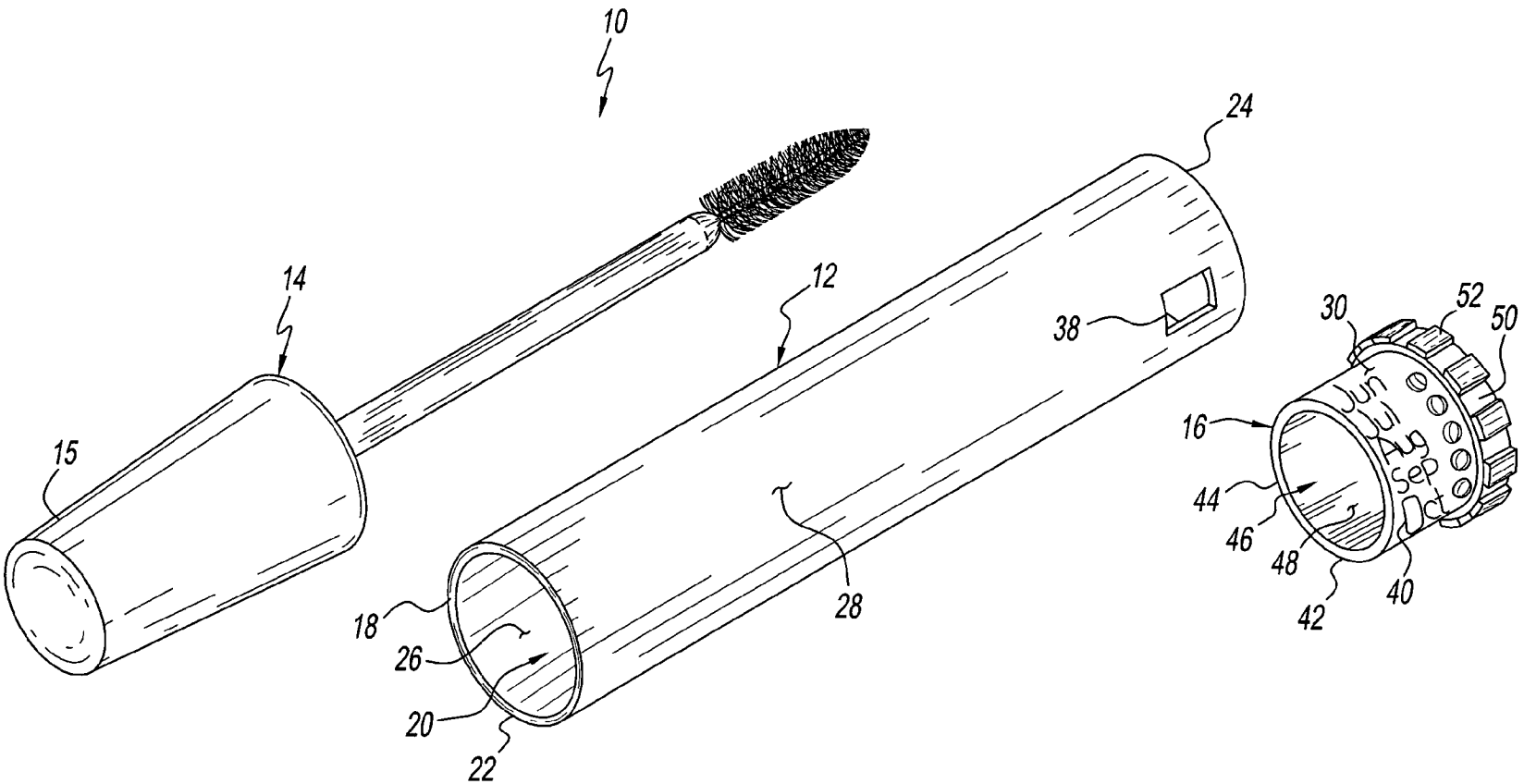
FIG. 1 is an exploded assembly view of a make-up container having an adjustable date control according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical order. It should be understood that steps within a method may be executed in different order without altering the principles of the present disclosure.

Trying to remember the month in which a make-up container was purchased and the month in which it should be replaced is tedious. More specifically, a mascara container for example, would be benefited by having an adjustable date control that would allow a user to set an expiration date when the mascara is purchased and discard the container when the expiration date passes. This would prevent the contamination issues that occur when mascara is used after the expiration, which cause infections and other undesirable skin conditions. Additionally, discarding the container when recommended by the manufacturer prevents using perishable mascara that has begun to clump and has reduced performance characteristics, which based on customer perception, reflects poorly on the manufacturer.

With reference to FIG. 1, an adjustable date control system 10 is shown and includes a make-up container 12, applicator 14, and an adjustable date control 16. The container 12 has a circumferential wall 18 that defines an opening into a chamber 20 at each of a first end 22 and a second end 24 of the container 12. The chamber 20 is defined by an interior 26 and an exterior surface 28. The first end 22 of the container 12 receives the applicator 14 that is inserted in the container 12 where a make-up media (NOT SHOWN) is stored. The applicator 14 has a handle portion 15 that allows the user to remove the applicator 14 from the container 12 and apply the make-up media to their face.

The open second end 24 of the container 12 allows the control 16 to be attached to the interior surface 26 of the container 12. The control 16 can be securely attached so that it will not come out of the container 12 by including a retaining means on the interior surface 26 of the container, on an exterior surface 30 of the control or both. For example, the exterior surface 30 of the control 16 may have a plurality of male protuberances 32 formed thereon that are each received by one of a plurality of female notches 34 (shown in FIG. 6) that are formed on the interior surface 26. Alternatively, the interior surface 26 of the container 12 may have the plurality of male protuberances 32 formed thereon and the exterior surface 30 of the control 16 may have the plurality of female notches 34 formed therein (shown in FIG. 5). Alternatively, the control 16 may be retained in the container simply by sizing them so to form an interference fit therebetween. Alternatively, any mechanical fastening means known to one skilled in the art may be used to rigidly attach the control 16 to the container 12.

The interior 26 and the exterior surface 28 define an aperture 38 formed therein and providing communication therebetween. The aperture 38 enables a user to see one of a plurality of expiration date-months 40 formed on the exterior surface 30 of the control 16 when the user rotates the control 16. The aperture 38 is shown having a rectangular shape, however, it is understood that any desired shape known to one skilled in the art may be used. An exemplary expiration date-month 40 for the make-up media is shown in the aperture 38 in FIG. 2. The expiration date is shown simply by month, for example, 'Sep' is shown and represents September. The exterior surface 30 of the control 16 may include each of the twelve months in a sequential order to allow the user to rotate the control 16 to the desired date-month.

The control 16 has a circumferential wall 42 that defines an opening into a first end 44 of a cylinder 46 that is defined by an interior surface 48 of the circumferential wall 42. Opposite the opening into the cylinder 46 is a handle portion 50 formed on an exterior surface 30 of the control 16. The cylinder 46 allows additional make-up media to be stored therein. Therefore, when the control 16 is installed in the container 12, it does not reduce the total volume available to store make-up media. Alternatively, the control 16 can be formed without a cylinder 46 where volume is not a desired goal. For example, where cost and manufacturing simplicity are chiefly desired, a solid cross-section of the control 16 may be used.

Figure 9:
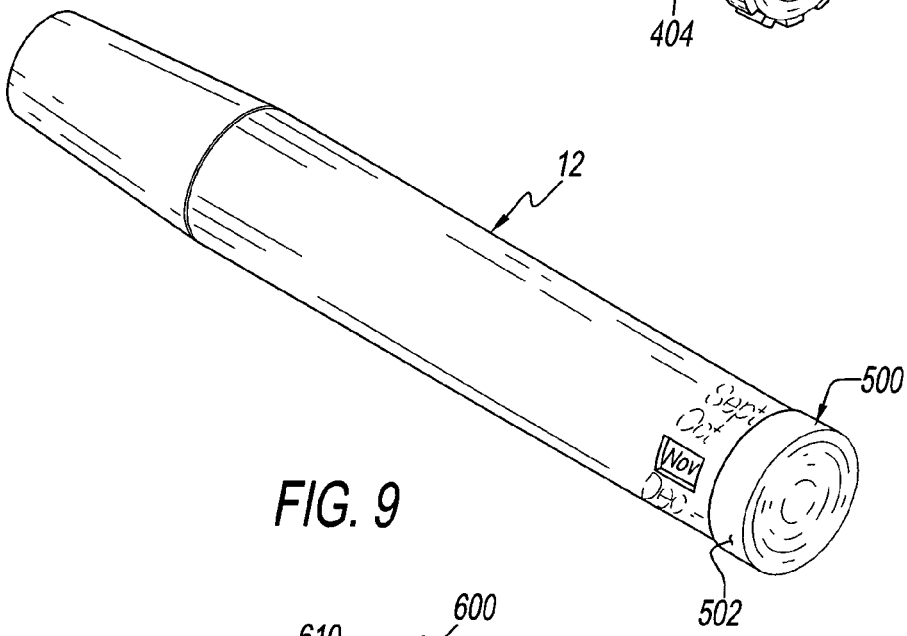
FIG. 9 is a perspective view of another preferred embodiment of the adjustable date control having a handle portion without splines.

The handle portion 50 of the control 16 may have raised surfaces 52 to enable a user to rotate the control 16 to the desired month. Alternatively, for aesthetic purposes, the exterior surface 30 of the control 16 may have a substantially smooth surface as shown in FIG. 9 that corresponds to the exterior surface 30 of the container 12. Additionally, the raised surfaces 52 of the control 12 can be substituted by using arcuate channels for a more pleasing appearance to the assembled container 12 (Not Shown). The control 16 may be limited to rotation in a first direction, for example only, as shown in FIG. 2, the control 16 rotates only in a first direction to simplify operation and reduce the chance that the control 16 is rotated unknowingly.

Figure 2:
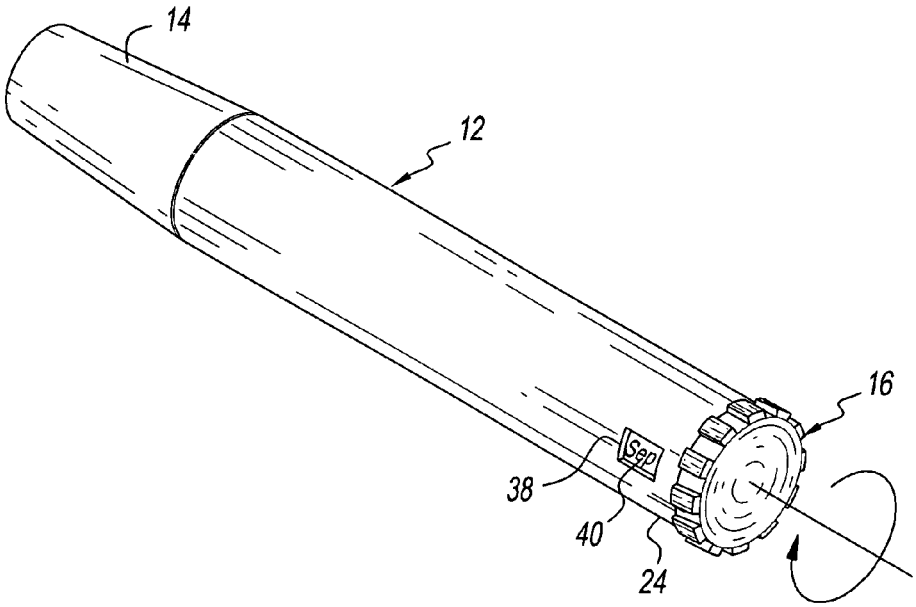
FIG. 2 is a perspective view of the container shown in FIG. 1 having an adjustable date control attached to an end of the container wherein an abbreviated expiration date-month of the container media is shown.

With reference to FIG. 2, the container 12 in FIG. 1 is shown having the control 16 attached at the second end 24 of the container 12. FIG. 2 illustrates the ability to rotate the control 16 about a centerline axis to any month and also may include a default position having no date characters (NOT SHOWN). For example only, the position with no date may be a factory default position indicating the need for the user to set the date-month to the proper expiration month.

The aperture 38 that allows one of the plurality of expiration date-months 40 to appear may have any shape, for example only, round or oval or a shape that conforms to the product manufacturer's logo or trademark. It is understood that the aperture 38 may be formed by any method known to one skilled in the art and may include a trim element (not shown). For example only, the trim element could be a metallic or plastic decorative piece used to improve the aesthetic appearance of the adjustable date control system 10 when assembled. It is envisioned that the control 16 and container 12 may have an attractive appearance to create further demand for the product.

Figure 3:
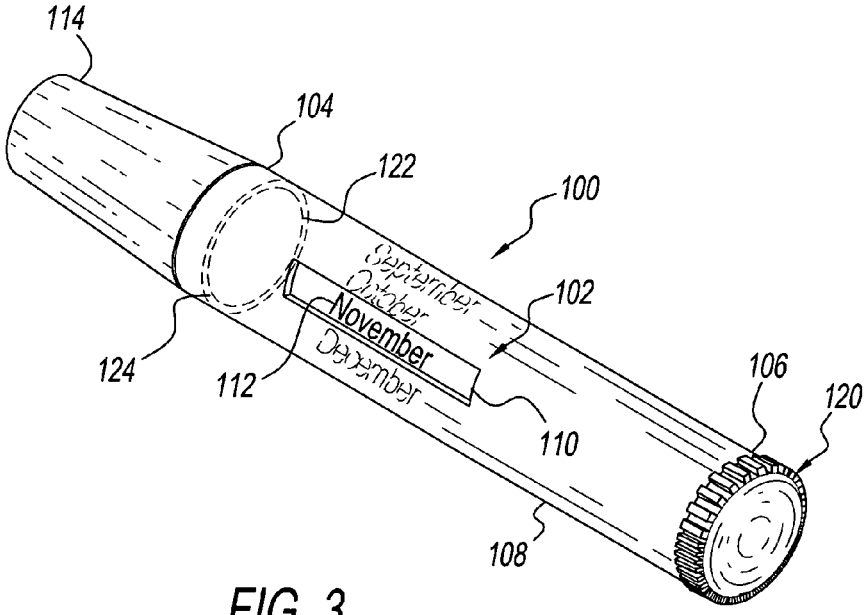
FIG. 3 is a perspective view of another embodiment of a make-up container having an adjustable date control wherein a full expiration date-month of the container media is shown.

With reference to FIG. 3, another embodiment of an adjustable date control system 100 is shown having an elongated aperture 110 that is positioned near a midpoint 102 between a first end 104 and a second end 106 of a container 108. Additionally, the elongated aperture 110 has a longer rectangular width which allows a full date-month 112 to be viewed rather than an abbreviated date month that is more easily ignored. This provides the user with a higher probability of noticing that the make-up media has expired. A control 120 would have a corresponding longer length and may extend from the second end 106 of the container to a position near the first end 104 of the container 108 where the applicator 114 is inserted. The control 120 would have a cylinder 122 that is substantially hollow at a first end 124 as shown in FIG. 1 wherein the make-up media could be stored in the cylinder 122 and accessed by the applicator 114.

Figure 4:
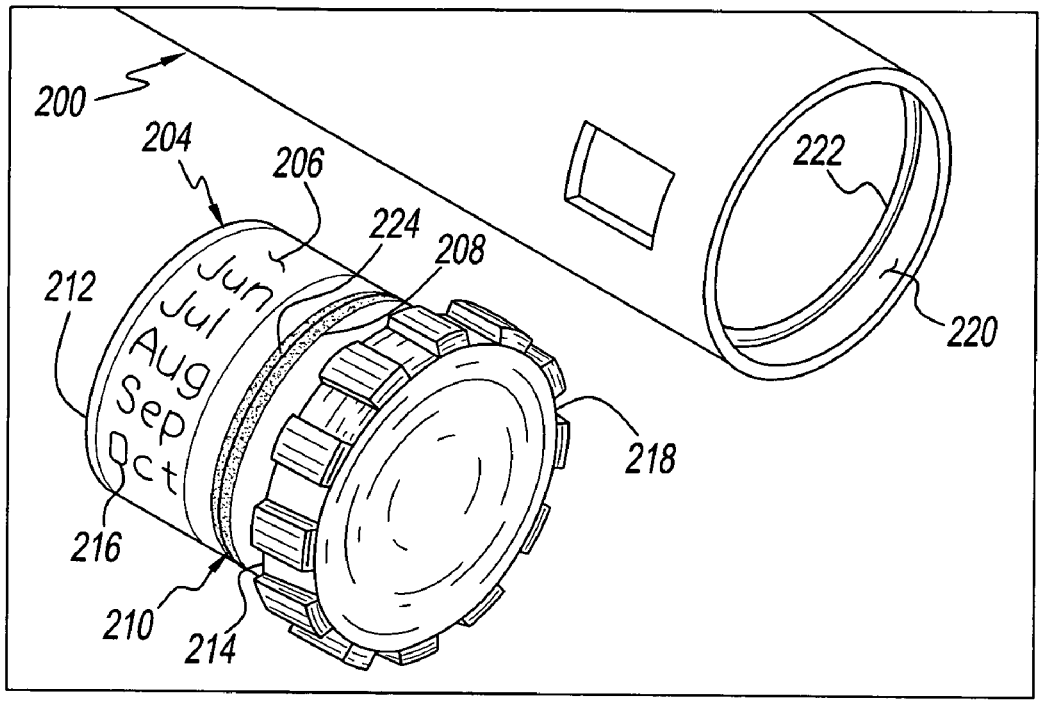
FIG. 4 is a partial perspective view of another preferred embodiment of a make-up container and an adjustable date control. The control having an o-ring seal formed on an exterior surface to prevent seepage of the make-up media to the exterior of the make-up container and a groove formed on an interior surface of the make-up container that receives the o-ring.
Figure 4A:
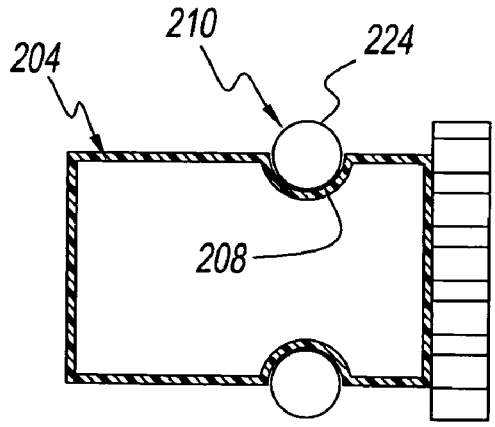
FIG. 4A is a cross-sectional view of the control shown in FIG. 4.

With reference to FIG. 4, another preferred embodiment of a container 200 and a control 204 are shown each having a sealing channel. An exterior surface 206 of the control 204 has a channel 208 formed therearound that receives an o-ring seal 210. The channel 208 is formed opposite a first end 212 of the control 204 near a second end 214 that is between a message portion 216 and a handle portion 218. Alternatively, the channel 208 may be formed near the first end 212 if so desired, without deviating from the scope of the invention. The o-ring 210 would prevent make-up media from seeping out of the container 200 and creates an interlock between the container 200 and control 204. An interior surface 220 of the container 200 includes a channel 222 formed therein that would receive a raised portion 224 of the o-ring 210 when the control 204 is inserted into the container 200. Each of the channels 208, 224 would share the same horizontal plane when mated. This would create seepage prevention and also provide an interlock between the control 204 and the container 200 that would prevent the control 204 from being removed from the container 200 during use. In FIG. 4A, the o-ring 210 is shown seated in the channel 208 formed in the control 204. The raised portion 224 of the o-ring 210 is shown and would fit into the channel 222 formed in the container 200.

Figure 5:
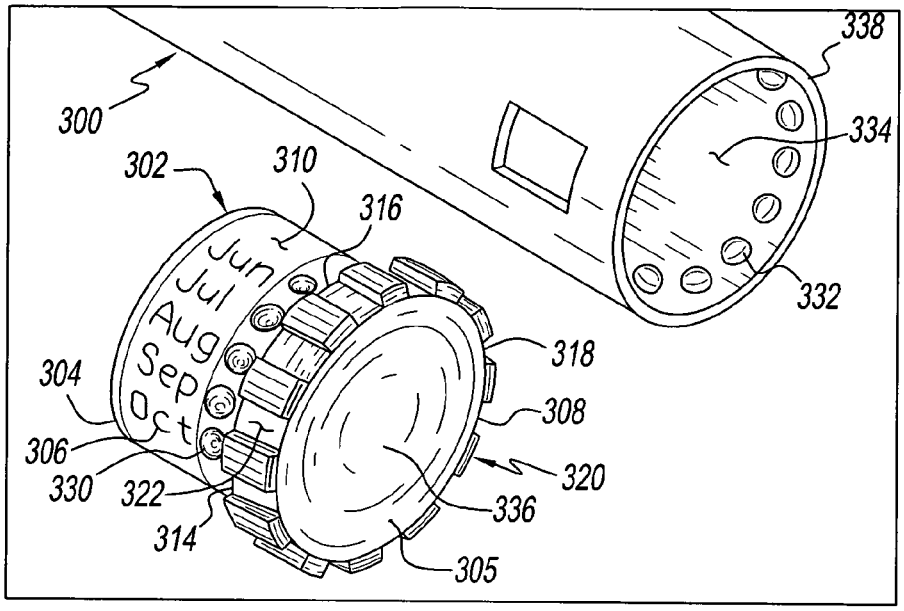
FIG. 5 is a partial perspective view of another embodiment of a make-up container and an adjustable date control having a plurality of female notches formed on an exterior surface of the adjustable date control and a plurality of male protuberances formed on an interior surface of the make-up container.

With reference to FIG. 5, another preferred embodiment of a container 300 and a control 302 are shown. The control 302 has a first end 304 that is inserted into the container 300 and a second end 305 that is used to rotate the control 302. The control 302 has a message portion 306 and a handle portion 308 formed on an exterior surface 310. The message portion 306 is defined by the exterior surface 310, which has a first diameter that is less than an inner diameter of the container 300. The handle portion 308 has a diameter that is greater than the outer diameter of the exterior surface 310 thereby forming a shoulder 314 as more clearly show in FIG. 10. The shoulder 314 prevents the control 302 from being inserted further into the container 300 than desired. The handle portion 308 has a first end 316 and a second end 318 that is spaced away from the first end 316 a predetermined distance. This distance can be selected to optimize the ability for any user to rotate the control 302 without negative ergonomic impact. Between the first and second ends 316, 318 of the handle portion 308 are splines 320 formed perpendicular thereon and spaced apart on an exterior surface 322 of the handle portion 308 at a predetermined distance, which is determined by aesthetic and ergonomic considerations.

Figure 13:
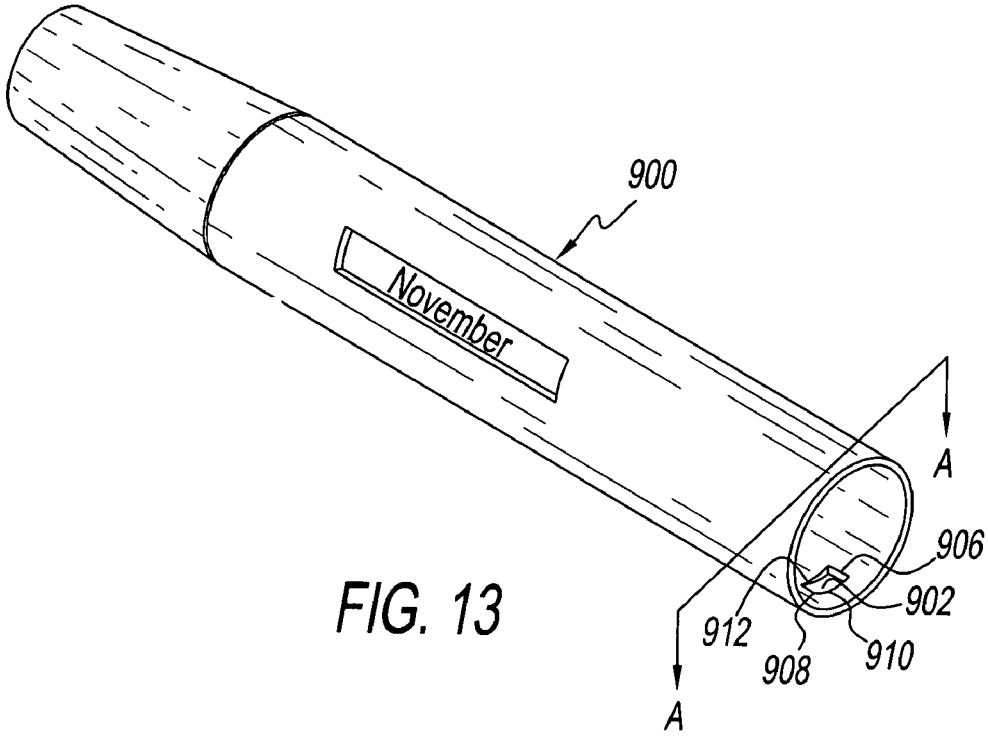
FIG. 13 is a perspective view of another preferred embodiment of a make-up container having an anti-rotation recess formed on an interior surface of the container.

The control 302 has a plurality of female notches 330 formed on the exterior surface 310 of near the message portion 306. A plurality of male protuberances 332 formed on an interior surface 334 of the container 300. One of each of the female notches 330 receives one of each of the male protuberances 332 when the control 302 is installed into the container 300. This ARR 902 angement provides an anti-rotation means when one of each of the plurality of male protuberances 332 is positioned into one of each of the plurality of female notches 330 as well as prevents the control 302 from being removed from the container 300. It is understood that the control 302 and or the container 300 may include any combination or orientation of notches and protuberances to prevent anti-rotation such as a pawl, spline or other locking recess known to one skilled in the art. FIG. 13 illustrates an exemplary anti-rotation recess, which allows rotation of a control only in a first direction thereby reducing the likelihood of an unintentional rotation.

Each of the plurality of female notches 330 is formed along a circumferential axis between the plurality of expiration date-months 334 and the handle portion 308 of the control 302. However, it is understood that the plurality of female notches 330 may be formed near the first end 304 of the control 302. Additionally, each of the plurality of female notches 330 may be formed in a position that is offset or between each of the plurality of expiration date-months 334 (Not Shown).

The handle portion 308 of the control 302 may have a diameter that is greater than an outer diameter of the container 300, enabling a user to simply grasp the control 302 and rotate it to the desired one of the plurality of date-months 334. The raised surfaces may have any shape desired, FIG. 5 shows a splined configuration that would be simple to mold, however, it is understood that more complex geometry can be used to design the handle portion 308 of the control 302 without deviating from the scope of the invention.

The second end 305 of the control 302 is shown having a substantially flat surface. However, it may be concave or convex to facilitate a more aesthetic appearance. Additionally, a concave surface 336 on the second end 305 of the control 302 may allow the user to rotate the control 302 by simply applying a rotational force against the concave surface 336 using a finger tip, for example only.

The plurality of male protuberances 332 may be placed such that the shoulder 314 of the handle portion 308 of the control 302 is offset a predetermined distance away from a second end 338 of the container 302 to allow a more smooth rotation when the control 302 is rotated in a first direction. This would prevent undesired surface-to-surface contact of the shoulder 314 and the second end 338 of the container 302.

Figure 6:
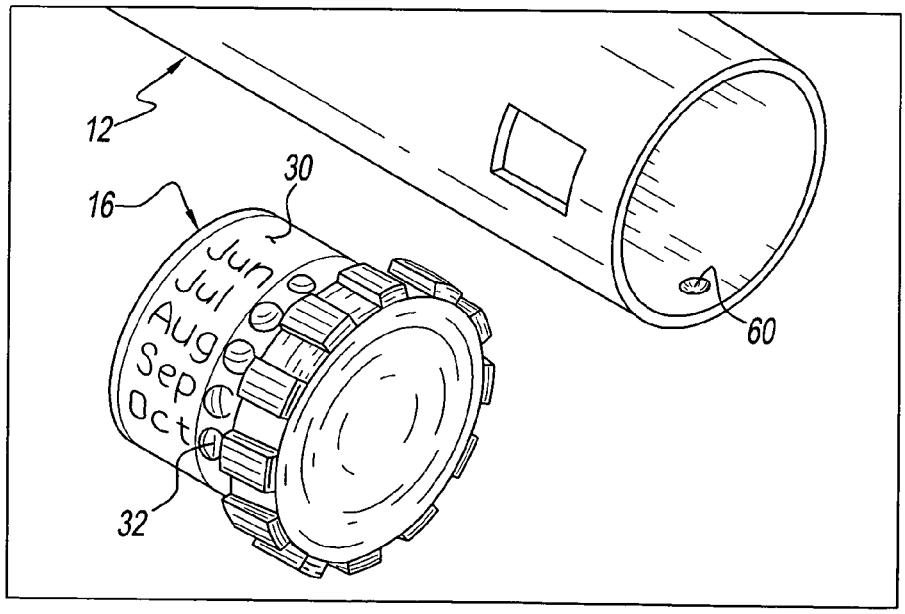
FIG. 6 is a partial perspective view of the make-up container and adjustable date control shown in FIG. 1. The control having a plurality of male protuberances formed on the exterior surface and a single female notch formed on an interior surface of the make-up container that receives one of the male protuberances as the adjustable date control is rotated.

FIG. 6 is the container 12 and the control 16 shown in FIG. 1 having a plurality of male protuberances formed on the exterior surface 30 of the control 16 and a single female notch 32 formed on an interior surface 26 of the container 12 that receives one of each of the plurality of male protuberances 32 as the control 16 is rotated. This embodiment would simplify forming the container 12 by simply having a single female notch 60. Additionally, this embodiment would allow less force to be exerted by a user when rotating the control 16 because it reduces the overall resistance from multiple interlocks to a single interlock.

In another preferred embodiment (not shown) the second end of the container 12 may have a first saw tooth configuration that mates to a second saw tooth configuration formed on a shoulder of the handle portion of the control 16. This arrangement would provide a substitute locking recess previously described as the female notch 60 and the plurality of male protuberances 32.

It is further envisioned that the control 16 may be adapted to any container 12 device in other arts such as foods or chemical compounds that are deemed perishable.

Figure 7:
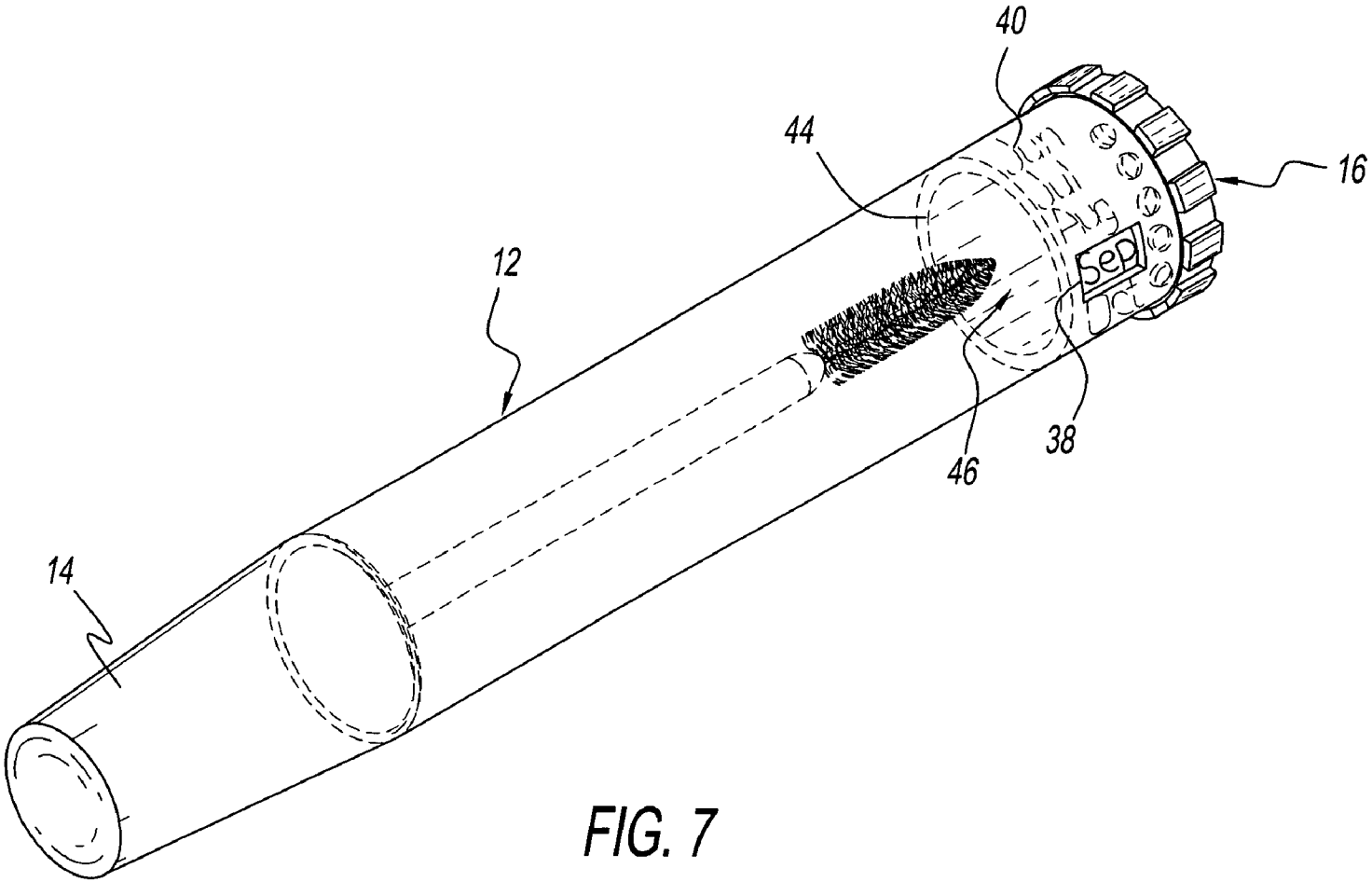
FIG. 7 is a perspective view of the make-up container shown in FIG. 1 showing a chamber of the adjustable date control that allows container media to be stored therein and thus increase the storage volume of the container.

With reference to FIG. 7, an assembled view of the container 12 shown in FIG. 1 is shown. The plurality of date-months 40 not appearing in the aperture 38 are shown in phantom as well as the first end 44 of the control 16 illustrating that it can store media and shows that the applicator 14 is long enough to access the additional make-up media located in the cylinder 46. This configuration demonstrates that the control 16 has an additional utility, storage space within itself.

The plurality of date-months 40 can be molded on the exterior surface 30 of the control 16, painted, inscribed or attached in any other method known to one skilled in the art. The plurality of date-months 40 are abbreviated but may be roman numerical as well. Each of the plurality of date-months 40 change in a chronological order that is formed in a first rotational direction (Clockwise) allowing the user to rotate the control 16 in a second rotational direction that is opposite the first rotational direction until the desired one of the plurality of expiration date-months is displayed.

Figure 8:
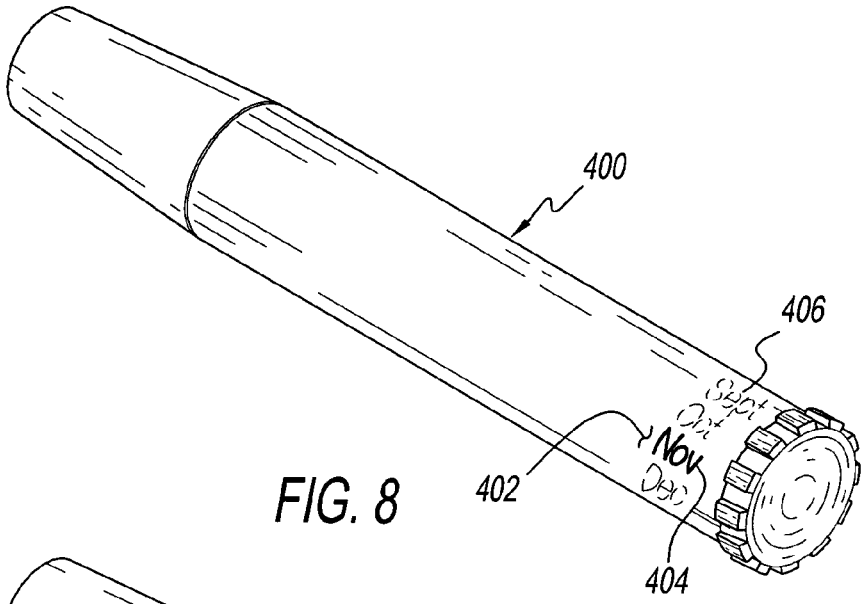
FIG. 8 is a perspective view of another preferred embodiment of a make-up container having a transparent area adjacent to a date-month formed on an adjustable date control. The transparent area allows the date-month to be visible by the user without the necessity of an aperture formed in the container.

With reference to FIG. 8, another preferred embodiment of the container 400 is shown having at least a partially transparent portion 402 enabling a user to see one of each of the plurality date-months through the container 402 while eliminating the need and tooling for forming an aperture. The abbreviated date-month 404 of November is shown in solid lines as 'Nov' indicating that it is visible through the partially transparent portion 402 that is used to form at least a portion of the container 400 while the other of the plurality of date-months 406 are shown in phantom lines indicating that they are not visible unless they appear through the partially transparent portion 402 of the container 400. Characters used to form the date-month may be any color or shape known to one skilled in the art, for example they may be in a color red to indicate a warning to STOP using the make-up media.

With Reference to FIG. 9, another preferred embodiment of a control 500 is shown and is attached to the container 12 shown in FIG. 1. The control 500 is attached and functions as the control 16 in FIG. 1, however, the control 500 has a smooth exterior surface 502 to provide a more aesthetic look. The smooth exterior surface 502 although substantially smooth in appearance, may have a coating to promote easy rotation by the user when setting the control 500 to the desired date-month. The smooth exterior surface 502 of the control 500 eliminates additional tooling feasibility and tooling complexity by eliminating the raised surfaces 52 formed on the handle portion 50 of the control 16 in FIG. 1. Additionally, the smooth exterior surface 502 may give the purchaser the idea that the container 12 and control 500 are integral and thus provide more consumer desire due to the enhanced appearance.

Figure 10:
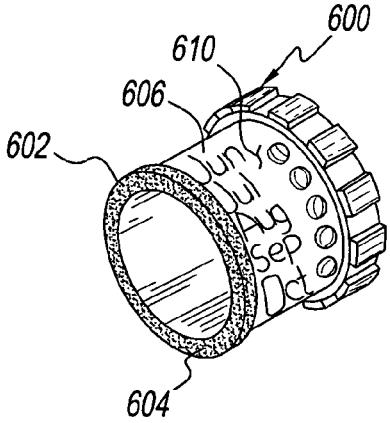
FIG. 10 is a perspective view of another preferred embodiment of an adjustable date control having a flange formed on a first end.

With Reference to FIG. 10, another preferred embodiment of a control 600 is shown having a flange 602 formed near a first end 604 of the control 600. The flange 602 has an outer diameter that is greater than the diameter of a message portion 606 of the control 600. The flange 602 will provide an interlock between the control 600 and the container 608. It is intended that the control 600 be positioned in a mold tool and the container could be "shot" or molded around an exterior surface 610 of the flange 602 and the message portion 606 of the control 600 as shown in detail in FIG. 12.

Figure 11:
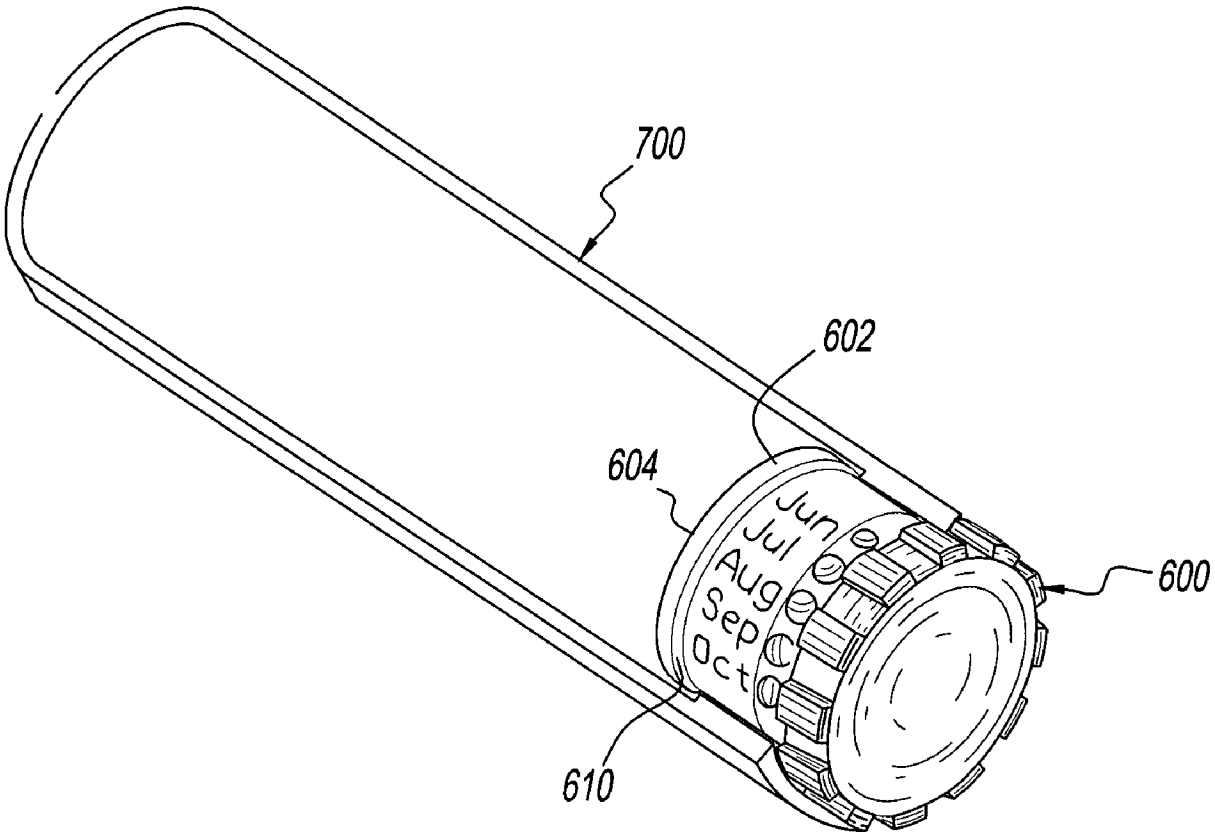
FIG. 11 is a partial perspective cut-away view of the control having a flange as shown in FIG. 10. The control is placed in an exemplary mold tool where a make-up container is molded around the control. The container has a flange that mates with the flange on the control thereby providing an interlock.

With reference to FIG. 11, the control 600 shown in FIG. 10 is shown having another preferred embodiment of the container 700 formed around the exterior surface 610 of the control 600. This is accomplished by forming the container 700 around the control 600 or providing an angled surface on the first end 604 of the flange 602 opposite a second end 610 such that the control 600 can be inserted into the container 700 but not removed. The container 700 is shown cut-away to illustrate the interlock between the control 600 and container 700.

Figure 12:
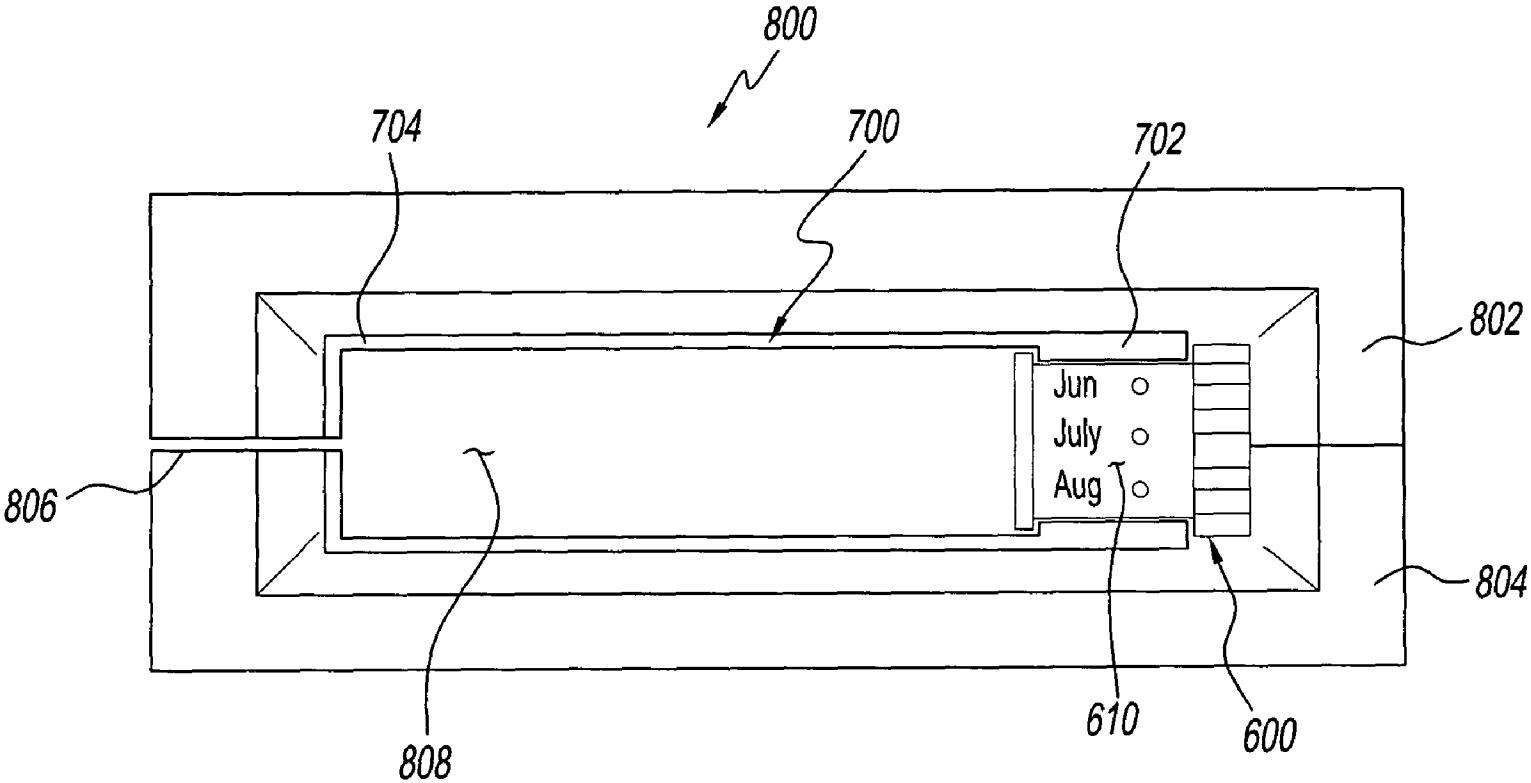
FIG. 12 is a side view of the control and container shown in FIG. 11 formed in a molding tool.

With reference to FIG. 12, an exemplary injection mold system 800 is shown in a closed position. The injection mold system 800 having an upper cavity 802 and a lower cavity 804. Between the upper 802 and lower cavities 804, a runner 806 is formed to allow the molds to fill and form the container 700. The injection mold system 800 would include a retractable core portion 808 that would provide the container 700 with the desired shape by allowing the mold to fill between the core 808 and the cavities 802, 804 as is known in the art of injection molding.

The container 700 can be "shot" or molded around the exterior surface 610 of the control 600 using, for example, a dissimilar material that will not bond to the exterior surface 610 of the control 600. The container 700 may be overmolded around the control 600 to eliminate an assembly sequence and cost.

A portion of the container 700 that surrounds the exterior surface 610 of the control 600 has a first thickness that is greater than the container 700 at an adjacent end 704 near the runner 806. This thickness creates an inner diameter of the container 700 that is less than the outer diameter of the flange 602 thereby providing an interlock. After the container 700 is molded around the control 600, the flange 602 would provide an interlock therebetween, leaving the control 600 free to rotate within the container 700 absent an anti-rotation device (Not Shown). A thickness 706 of the adjacent end 704 of the container 700 is less than the first thickness that surrounds the exterior surface 610 of the control 600, this maximizes the volume of the container 700 while providing an interlock that allows the container 700 to be formed integral to the control 600.

With reference to FIG. 13, another preferred embodiment of the container 900 is shown having an anti-rotation recess 902 (ARR) that prevents a control 900 from rotating in more than one direction, thereby reducing the chance of an unintentional rotation by 50%. The ARR 902 is formed as a recess in a circumferential wall 904 of the container. The ARR 902 has a substantially vertical wall 906 parallel but spaced apart by a predetermined amount from a transitional step 908. When a male protuberance is placed in the ARR 902, it can rotate out of the ARR 902 only in the direction facing the transitional step. In contrast, it is prevented from rotating out of the ARR 902 in the direction of the substantially vertical wall 906. The ARR 902 has a pair of lateral walls 910, 912 spaced apart a predetermined amount that is determined based on the diameter of the male protuberance it receives. Each of the laterals walls 910, 912 joins the vertical wall 906 and the transitional step 908.

Figure 13A:
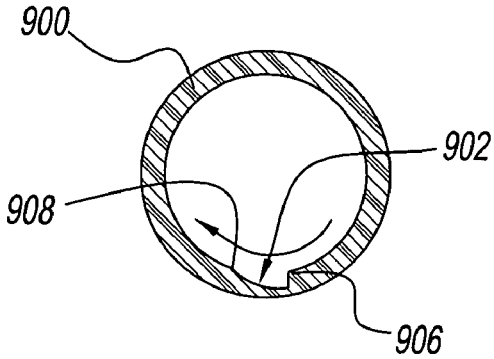
FIG. 13A is a cross-sectional view of the container in FIG. 13 showing the anti-rotational recess.

With reference to FIG. 13A, a cross-sectional view of the ARR 902 is shown to illustrate the geometry of the ARR 902 and the uni-directional rotation. The transitional step 908 would enable the male protuberance formed on a control to rotate in a first direction, here, clockwise while the substantially vertical wall 906 would prevent the male protuberance formed on a control from rotating in a second direction.

Those skilled in the art can now appreciate from the foregoing description that the broad teachings of the disclosure may be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A system for providing an expiration month on cosmetic containers that store perishable make-up media, comprising:

a container having a circumferential wall that defines an opening into a cylinder at each of a first and a second end of the container, the cylinder is defined by an interior and an exterior surface wherein the interior and exterior surfaces define an aperture providing communication therebetween;

a control having a circumferential wall that defines an opening into a first end of a chamber, wherein the chamber is defined by an interior surface of the circumferential wall that provides storage space for make-up media and wherein the circumferential wall of the control has a message portion formed on an exterior surface that is visible through the aperture wherein the message portion of the control is rotationally engaged in the opening of the first or second end of the container;

a first handle portion formed on the control wherein the first handle portion has a greater outer diameter than an outer diameter of the message portion of the control wherein the greater outer diameter prevents the first handle portion from entering the cylinder;

a second handle portion having a make-up media applicator member extending therefrom, wherein the applicator member is selectively operable to be received within the other opening of the first or second end of the container, wherein the second handle portion is spaced from and opposed to the first handle portion; and a plurality of date-months formed on the message portion of the control in a sequential order in a first circumferential direction wherein the first handle portion rotates the control in a second circumferential direction that is opposite the first circumferential direction thereby changing the date-months until the desired expiration date-month is visible in the aperture.

2. The system of claim 1 wherein the first handle portion includes a plurality of raised surfaces formed circumferentially thereon, wherein the raised surfaces are spaced apart a predetermined amount and are positioned between a first and a second end of the first handle portion.

3. The system of claim 1 wherein at least one male protuberance is formed on one of the message portion of the control or on the interior surface of the cylinder.

4. The system of claim 3 wherein at least one female retaining feature is formed on the other of the message portion of the control or in the interior surface of the cylinder wherein the at least one female retaining feature and the at least one male protuberance form an interlock to prevent the control from being removed from the container.

5. The system of claim 4 wherein the interlock prevents the control from an unintentional rotation within the container.

6. The system of claim 4 wherein the interlock permits an intentional rotation within the container.

7. The system of claim 1 wherein each date-month is in an abbreviated format.

* * * * *